US011021671B2

(12) United States Patent
Eggen et al.

(10) Patent No.: US 11,021,671 B2
(45) Date of Patent: Jun. 1, 2021

(54) BEARING FLUSHING COMPOSITIONS AND METHODS

(71) Applicant: Tire Seal, Inc., Lake Worth, FL (US)

(72) Inventors: Mark Eggen, Lake Worth, FL (US); David L. Wooton, Bumpass, VA (US); Paul J. Erdek, Lake Worth, FL (US)

(73) Assignee: Tire Seal, Inc., Lake Worth, FL (US)

( * ) Notice: Subject to any disclaimer, the term of this patent is extended or adjusted under 35 U.S.C. 154(b) by 0 days.

(21) Appl. No.: 16/198,470

(22) Filed: Nov. 21, 2018

(65) Prior Publication Data

US 2019/0153350 A1 May 23, 2019

Related U.S. Application Data

(60) Provisional application No. 62/590,090, filed on Nov. 22, 2017, provisional application No. 62/593,641, filed on Dec. 1, 2017.

(51) Int. Cl.

| | |
|---|---|
| ***C10M 169/00*** | (2006.01) |
| ***C10M 169/02*** | (2006.01) |
| ***C10M 115/10*** | (2006.01) |
| *C10N 50/02* | (2006.01) |
| *C10N 30/00* | (2006.01) |
| *C10N 40/02* | (2006.01) |
| *C10N 50/10* | (2006.01) |

(52) U.S. Cl.

CPC ..... *C10M 169/02* (2013.01); *C10M 115/10* (2013.01); *C10M 2205/028* (2013.01); *C10M 2209/1033* (2013.01); *C10M 2219/044* (2013.01); *C10M 2219/0445* (2013.01); *C10N 2030/22* (2020.05); *C10N 2040/02* (2013.01); *C10N 2050/02* (2013.01); *C10N 2050/10* (2013.01)

(58) Field of Classification Search

CPC ..... C10M 169/02; C10M 115/10; C10M 2209/1033; C10M 2219/0445; C10M 2205/028; C10M 2219/044; C10N 2230/22; C10N 2250/10; C10N 2050/02; C10N 2240/02

See application file for complete search history.

(56) References Cited

U.S. PATENT DOCUMENTS

| | | | | |
|---|---|---|---|---|
| 4,636,007 | A | 1/1987 | Persons | |
| 7,241,723 | B2 | 7/2007 | Zhang et al. | |
| 2005/0054541 | A1* | 3/2005 | Zhang | C10M 169/06 508/180 |
| 2006/0231576 | A1* | 10/2006 | Linkletter | F16N 3/12 222/256 |
| 2010/0105585 | A1* | 4/2010 | Carey | C10M 141/10 508/162 |

OTHER PUBLICATIONS

World Intellectual Property Organization, "International Search Report and Written Opinion," issued in International Patent Application No. PCT/US2018/062316, dated Jan. 29, 2019, documents of 8 pages.

* cited by examiner

*Primary Examiner* — Taiwo Oladapo
(74) *Attorney, Agent, or Firm* — Akerman LLP

(57) ABSTRACT

A bearing flushing composition includes a grease component and a solvent component. The grease component may include a grease thickener component, a base oil component, and, optionally, a performance additive component. The solvent component may include one or more solvent agents blended with the grease component.

18 Claims, 4 Drawing Sheets

BEARING FLUSHING COMPOSITIONS AND METHODS

CROSS-REFERENCE TO RELATED APPLICATIONS

This patent application claims priority under 35 U.S.C. § 119(e) to U.S. Provisional Patent Application No. 62/590,090, filed Nov. 22, 2017, and to U.S. Provisional Patent Application No. 62/593,641, filed Dec. 1, 2017. U.S. Provisional Patent Application No. 62/590,090 and U.S. Provisional Patent Application No. 62/593,641 are hereby incorporated by reference into this specification.

TECHNICAL FIELD

The present disclosure relates to bearing flushing compositions and methods of flushing bearings and bearing assembly housings, particularly flushing used grease from bearing assemblies of rotating equipment and industrial machinery.

BACKGROUND

Bearings may be used to support rotating components in various household and industrial environments. Wind turbine generators, for example, employ bearings to support rotation of a main shaft. Lubricants may also be used to reduce friction and thermal build-up. The most common lubricant used in main bearings of wind turbine generators is grease which has the advantage of being easily retained in the bearing arrangement and contributes to sealing the bearing arrangement from contamination.

Over time grease decomposition products, concentration of grease thickeners, collection of wear debris, and dirt and dust accumulation in the in-service grease because of operation of the equipment, equipment wear, heating of the grease and contact with the atmosphere causing the grease to thicken, increase in viscosity, and harden into sludge. An accumulation of this hardened grease will eventually cause the bearing to overheat, exhibit decreased efficiency, and ultimately fail.

To properly maintain the bearing, hardened grease that has accumulated on the bearing and bearing housing must be periodically removed from the bearing and bearing housing and replaced with fresh grease.

SUMMARY

In one aspect, a bearing flushing composition includes a grease component and a solvent component. The grease component may include a grease thickener component, a base oil component, and, optionally, a performance additive component. The solvent component may include one or more solvent agents blended with the grease component.

In one example, the composition may include approximately 3% to approximately 20% by weight solvent component. In a further example of the above example or in another example, the composition may include approximately 80% to approximately 97% grease component. In still a further example of an above example or in another example, the grease component may include approximately 1% to approximately 10% performance additive component. In yet a further example of an above example or in another example, the performance additive component may include one or more performance additives selected from one or more antioxidant agents, one or more friction modifier agents, one or more anti-wear agents, one or more extreme pressure agents, one or more antirust agents, one or more overbased acid controllers, and any combination thereof. In yet a further example of an above example or in another example, the solvent component may include one or more oil soluble solvent agents solubilized into the grease thickener component. In still a further example of an above example or in another example, the solvent component may include one or more solvent agents solubilized in the grease component. In still yet a further example of an above example or in another example, the solvent component is solubilized into the grease component.

In another aspect, a method of flushing a bearing assembly includes introducing a bearing flushing composition into a bearing assembly housing comprising a bearing and introducing a replacement grease into the bearing assembly housing. The bearing flushing composition may include a solvent component blended with a grease component. Introducing the bearing flushing composition into the bearing assembly housing may displace grease resident in the bearing assembly housing from the bearing assembly housing. Introducing the replacement grease into the bearing assembly housing may displace the bearing flushing composition from the bearing assembly housing.

In one example, the method further includes operating the bearing for a run time after introducing the bearing flushing composition while the bearing flushing composition is resident in the bearing assembly housing. In a further example, the run time is at least 4 hours. In a further example of an above example or in another example, the bearing flushing composition and the replacement grease are introduced into the bearing assembly housing through a grease inlet. The grease inlet may include a Zerk type fitting. In still a further example of an above example or in another example, displacement of the grease resident in the bearing assembly housing upon introducing the bearing flushing agent flushes the grease from the bearing assembly housing through a grease outlet. The grease outlet may include a Zerk type fitting. In a further example of an above example or in another example, the bearing flushing agent is introduced when the bearing is in service. In still a further example of an above example or in another example, the replacement grease is introduced when the bearing is in service. In yet a further example of an above example or in another example, the grease component includes a grease thickener component, base oil component, and, optionally, a performance additive component. In still yet a further example of an above example or in another example, the solvent component includes one or more solvent agents blended with the grease component. In a further example of an above example or in another example, the bearing flushing composition includes approximately 3% to approximately 20% by weight solvent component. In still a further example of an above example or in another example, the bearing flushing composition includes approximately 80% to approximately 97% grease component. In yet a further example of an above example or in another example, the grease component includes approximately 1% to approximately 10% performance additive component. In a further example of the above example, the performance additive component comprises one or more performance additives selected from one or more antioxidant agents, one or more friction modifier agents, one or more anti-wear agents, one or more extreme pressure agents, one or more antirust agents, one or more polishing agents, and any combination thereof. In a further example of an above example or in another example, the solvent component comprises one or more oil soluble solvent agents solubilized into the grease thickener component. In still a further example of an above example or in another example, the solvent component includes one or more solvent agents solubilized in the grease component. In yet a further example of an above example or in another example, the solvent component is solubilized into the grease component.

BRIEF DESCRIPTION OF THE DRAWINGS

Various features and characteristics of the non-limiting and non-exhaustive embodiments disclosed and described in this specification may be better understood by reference to the accompanying figures, in which.

DESCRIPTION

Figure 1A:
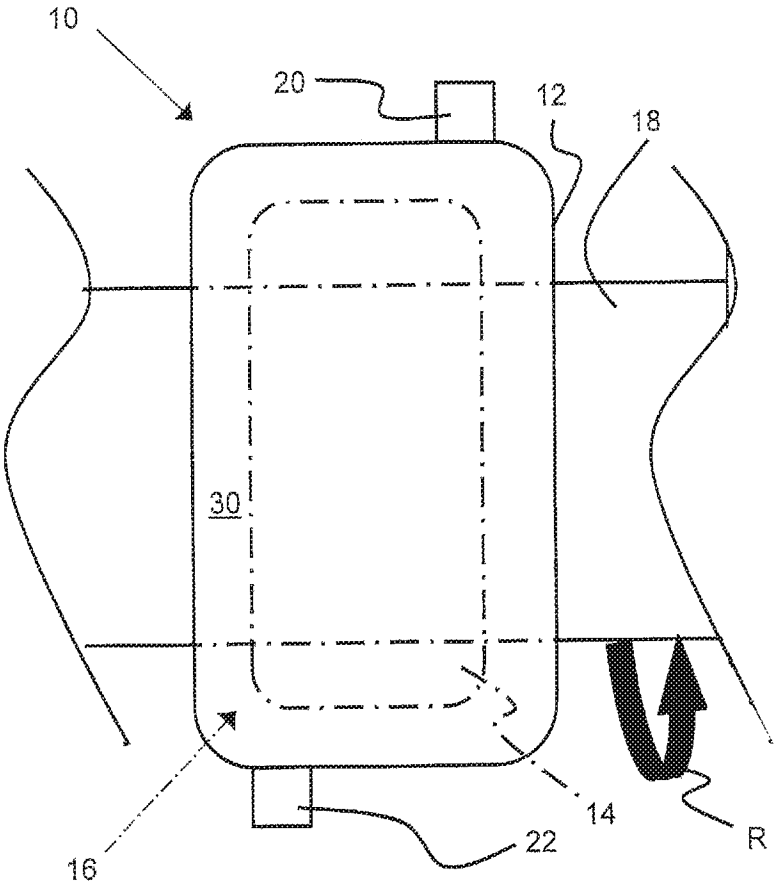
FIGS. 1A-1D schematically illustrate a method of flushing a bearing assembly according to various embodiments.

When grease in bearings degrades and hardens, it is no longer useful as lubricant, which can lead to overheating, bearings lock-up, and downtime on the piece of equipment with locked bearings. To combat such undesirable outcomes, the old, in service grease is preferably removed from the bearing and replaced before equipment failure occurs. However, the difficulty in replacing the grease lies in removal of the depleted and contaminated grease to be replaced from the bearing. For example, the rotating equipment in which the bearing services may be required to be taken offline for grease changeout, which may also include removing or exposing bearings to gain access to the bearings for cleaning. Incomplete removal of the old, in service grease can contaminate the new grease and reduce its lubricant properties as well as its operational life. According to various embodiments, the present disclosure describes compositions and methods for flushing old, in service grease, which may include accumulated hardened grease, sludge, and debris, from bearing assemblies such as bearings and bearing assembly housings of rotating equipment and industrial machinery.

In some embodiments, the compositions and methods may be employed for cleaning a bearing in rotating equipment and industrial machinery that includes flushing the bearing and bearing assembly housing of accumulated hardened grease, sludge, and debris, thereby enabling a user to clean and then re-lubricate the bearing. For example, in some embodiments, the compositions and methods may be utilized to flush old, in service grease from bearings and bearing assembly housings of rotating equipment and industrial machinery while the equipment or machinery remains on-line. In the above or another embodiment, the compositions and methods may be utilized to flush old, in service grease from assembled bearings and bearing assembly housings of rotating equipment and industrial machinery, e.g., without requirement for disassembling the bearings in order to clean them.

Bearing flushing compositions of the present disclosure may include a grease component and a solvent component. The solvent component may be blended within the grease component.

In some embodiments, the bearing flushing composition may include, for example, approximately 70% to approximately 99% grease component by weight. In one example, the bearing flushing composition includes approximately 72% to approximately 96% grease component by weight. In various embodiments, the bearing flushing com-position includes at least 65%, at least 70%, at least 75%, at least 80%, at least 85%, at least 90%, or at least 95% grease component be weight. For example, in some embodiments, the bearing flushing composition includes approximately 70%, approximately 75%, approximately 80%, approximately 85%, approximately 88%, approximately 90%, approximately 92%, or approximately 95% grease component by weight. The balance of the weight of bearing flushing agent may include or consist of solvent component.

The bearing flushing composition may include, for example, approximately 1% to approximately 50% solvent component by weight. In one example, the bearing flushing composition includes approximately 1% to approximately 30% or approximately 3% to approximately 20% solvent component by weight. In various embodiments, the bearing flushing composition includes at least 3%, at least 5%, at least 10%, at least 15%, at least 20%, or at least 25% solvent component be weight. For example, in some embodiments, the bearing flushing composition includes approximately 3%, approximately 5%, approximately 10%, approximately 15%, or approximately 20% solvent component by weight. The balance of the weight of bearing flushing composition may include or consist of grease component.

The grease component may be a commercial grease or one that has been formulated for this application. The grease component may include a grease thickener component. In various embodiments, the grease component comprises approximately 5% to approximately 20%, such as approximately 10% to approximately 15%, grease thickener by weight. In other embodiments, greater or lesser weight percent of grease thickener may be appropriate.

The grease thickener component may include one or more grease thickener agents. Grease thickener agents may include, e.g., simple soaps (such as those based on salts of calcium, lithium, aluminum barium, sodium), complex soaps (such as those based on salts of calcium, lithium, and aluminum and salts of difunctional carboxylic acid, boric acid, or aromatic acid), organophilic clays, polyurea, or fluoropolymers, to name a few. In various embodiments, the grease thickener component may include one or more grease thickeners selected from metal soaps, metal complex soaps, carbonates, clays, silicas, polyureas, sulphonates, or combinations thereof.

The base oil component may include one or more base oils. The one or more base oils may be base oils known in the art.

In various embodiments, the grease component comprises approximately 75% to approximately 95%, such as approximately 80% to approximately 90%, base oil by weight. In other embodiments, greater or lesser weight percent of base oil component may be appropriate.

In some embodiments, the grease component includes a performance additive component. The performance additive component may include one or more performance additive agents formulated to extend the life, effectiveness, efficiency, or operational performance of the grease, such as one or more antioxidant agents, friction modifier agents, antiwear agents, extreme pressure agents, antirust agents, or polishing agents. In various embodiments, the grease component includes 0% to approximately 25% by weight performance additive component. For example, the grease component may include approximately 20% or less, approximately 15% or less, approximately 10% or less, approximately 5% or less performance additive component. In one example, the grease component includes between approximately 1% to approximately 10% performance additive by weight. In other embodiments, greater or lesser weight percent of base oil component may be appropriate.

In various embodiments, the bearing flushing composition includes approximately 0.01% to approximately 15% antioxidant additive comprising one or more antioxidant agents. Antioxidant agents may include, for example, hindered phenols, alkylated phenols, alkyl amines, aryl amines, hexamine, phenylenediamine, 2,6-di-tert-butyl-4-methylphenol, 4,4'-di-tert-octyldiphenylamine, bis(nonylphenyl)amine, dimethylethanolamine, tert-butyl hydroquinone, tris(2,4-di-tert-butylphenyl)phosphate, phosphites, thioesters, or combinations of thereof.

In various embodiments, the bearing flushing composition includes approximately 0.01% to approximately 15% friction modifier additive comprising one or more friction modifier agents. Friction modifier agents may include, for example, chalcogenides, such as molybdenum disulfide, tungsten disulfide, niobium diselenide, or a combination thereof, polytetrafluoroethylene, hexagonal boron nitride, soft metals (such as, for example, silver, lead, nickel, copper), cerium fluoride, zinc oxide, silver sulfate, cadmium iodide, lead iodide, barium fluoride, tin sulfide, zinc phosphate, zinc sulfide, mica, boron nitrate, borax, fluorinated carbon, zinc phosphide, boron, graphite, or a combination thereof In various embodiments, the bearing flushing composition includes approximately 0.01% to approximately 15% anti-wear additive comprising one or more anti-wear agents. Anti-wear agents may include, for example, tricresyl phosphate, zinc phosphates, such as a zinc dithiophosphate or zinc dialkyldithiophosphate, or combinations thereof.

In various embodiments, the bearing flushing composition includes approximately 0.01% to approximately 15% extreme pressure additive comprising one or more extreme pressure agents. Extreme pressure agents may include, for example, molybdenum compounds, polysulfides, chlorinated alkanes, oil soluble organophosphates, chlorendic acid esters, chlorinated paraffins, or combinations thereof.

In various embodiments, the bearing flushing composition includes approximately 0.01% to approximately 15% anti-rust additive comprising one or more anti-rust agents. Anti-rust agents may include, for example, alkaline earth metal bisalkylphenolsulphonates, dithiophosphates, alkenylsuccinic acid half-amides, or combinations thereof.

In various embodiments, the bearing flushing composition includes approximately 0.01% to approximately 20% acid control additive comprising one or more acid controllers. Acid controllers may include, for example, a soft mineral powder, such as calcium carbonate.

In various embodiments, the bearing flushing composition comprises (a) approximately 5% to approximately 20%, such as approximately 8% to approximately 12%, grease thickener by weight; (b) approximately 60% to approximately 75%, such as approximately 65% to approximately 70%, base oil by weight; and (c) approximately 0% to approximately 15%, such as approximately 1% to approximately 10% performance additive component by weight. Other weights may be used, such as those otherwise indicated herein.

In various embodiments, one or more of the grease thickener component, fluid base oil component, additive component, or agents thereof may be selected from those specified for the bearings and bearing assembly housings of the particular grease application at hand. For example, the grease component may include the same or similar grease thickener, fluid base oil, additives, or combinations thereof as the grease it is used to flush. In the above or another example, the weight ratio of one or more of the grease thickener, fluid base oil, or additives in the grease component may be the same or similar to that of the grease it is used to flush.

As introduced above, the bearing flushing composition may include a solvent component. The solvent component may include one or more solvents. In various embodiments, the solvent component may include at least one solvent selected from oil soluble polyalkylene glycols, synthetic esters, terpenes, alkylbenzenes, alkyl naphthalenes, mineral oils, polyalphaolefin oils, or combinations thereof. In one embodiment, all or a portion of the solvent component may be solubilized within the grease thickener component. According to various embodiments, the solvent component or one or more solvents thereof may be utilized to particularly solubilize the grease thickener component or agents thereof and old, in-service grease to be removed, such as decomposed grease, allowing it to be flushed from a bearing. In so doing, the bearing may be cleaned of old hardened grease providing the operator a method to replace this flushing grease by normal purging methods without requiring dismantling of bearing assembly housings for cleaning.

In one example, the bearing flushing agent includes approximately 75% to approximately 85% grease component and approximately 25% to approximately 15% solvent component wherein the grease component comprises a calcium sulfonate complex grease and the solvent component comprises an oil soluble polyalkylene glycol.

In various embodiments, the grease component comprises an overbased calcium sulfonate complex grease and the solvent component comprises an oil soluble polyalkylene glycol. In the above or another embodiment, the overbased calcium sulfonate complex grease comprises from approximately 10% to approximately 20% by weight high viscosity polyalphaolefin oil. In any of the above or another embodiment, the overbased calcium sulfonate complex grease comprises from approximately 1% to approximately 3% by weight overbased calcium sulfonate. In any of the above or another embodiment, the composition may also include approximately 1 to approximately 5% by weight alkylbenzene sulfonate acid. In any of the above or another embodiment, the grease component may include an additive component comprising approximately 10% to approximately 20% by weight overbased acid controller, such as calcium carbonate. In any of the above or another embodiment, the grease component may include an additive component comprising approximately 1% to approximately 3% by weight anti-oxidant additive, such as bis(nonylphenyl)amine.

As introduced above, the bearing flushing composition may include a grease component and a solvent component, which may be blended into the grease component. According to various embodiments, a method of making the bearing flushing agent may include combining the grease component and solvent component and mixing to formulate a blended mixture. In some such or other embodiments, the solvent component or one or more solvents thereof may be solubilized into the grease component or one or more components thereof.

In one embodiment, the grease component, or one or more components or agents thereof, may be heated and combined with the solvent component, or one or more solvents thereof, which may also be heated. The combined ingredients may then be mixed to formulate a blended mixture. In one example of the method, a drum mixer may be charged with grease component and agitated. Heated solvent may then be added and the resultant mixture stirred to form a blended mixture. Duration of stirring may depend on the identities and amounts of the components being mixed, but generally stirring times may be undertaken for about 2 hours or at least 2 hours. For example, stirring may be undertaken for about 2.5 hours, 3 hours, 3.5 hours, 4 hours, or more. However, in some formulations lesser times may be appropriate. The blended mixture may then be used or packaged in suitable containers and stored.

A method of making a bearing flushing composition comprising approximately an 80:20 grease component to solvent component weight ration may include charging approximately 80 weight percent of a heated grease to a drum mixer and starting agitation. Approximately 20 weight percent of heated solvent, such as oil soluble polyalkylene glycol may be added to the drum. The resultant mixture may then be stirred for at least 2 hours prior to storage or packaging. While the bearing flushing composition is generally described as being formulated by mixing the grease component with the solvent component, it will be appreciated that is some embodiments the various components may be premixed or mixed in other orders. For example, an additive component or agent thereof could be premixed with all or a portion of one or more of the fluid base oil component, grease thickener component, or solvent component.

In various embodiments, the bearing flushing compositions disclosed herein generally comprises grease compositions formulated to be pumped into a bearing assembly housing to soften and flush the bearing and bearing assembly housing of old, in-service grease. For example, a method of flushing a bearing assembly, which may comprise a bearing and bearing assembly housing, may include forcing or pumping the bearing flushing composition into a bearing assembly housing. The method may also include purging the flushed depleted and contaminated grease from the bearing assembly housing and introducing, e.g., by forcing or pumping, fresh compatible grease into the bearing assembly housing to lubricate the bearing.

While various bearing systems are suitable for use with the bearing flushing compositions and methods of flushing bearings and bearing assembly housings disclosed herein, a preferred system is equipped with a grease Zerk fitting or other similarly effective inlet for introducing the bearing flushing composition into the bearing under pressure. As such, introduction of the bearing flushing composition into the bearing assembly housing may displace the contaminated grease present in the bearing. One preferred tool for use in forcing the bearing flushing composition into a bearing is a handheld grease gun having a hose with a fitting on the free end that is attachable to a grease Zerk fitting. Such handheld grease guns are known in the art and may utilize a handle-driven piston to expel the bearing flushing composition from an elongated cylindrical package into the hose and from the hose, through the grease Zerk fitting, and into the bearing system.

FIGS. 1A-1D, schematically illustrate a method of flushing a bearing assembly 10 according to various embodiments. The bearing assembly 10 may include a bearing assembly housing 12 that houses a bearing 14 (shown in ghost) within an interior portion 16 of the bearing assembly housing 12. The bearing assembly 10 may support a rotatable shaft 18 or other rotatable equipment or industrial machinery that extends through the interior portion 16 of the bearing assembly housing 12. The bearing assembly 10 may include a ports 20, 22 operable as a grease inlet 20 and a grease outlet 22 in fluid communication with the interior portion 16 of the bearing assembly housing 12. As noted above, the grease inlet 20 and grease outlet 22 may include Zerk type fittings.

With specific reference to FIG. 1A, the grease lubricant 30 may be contained in the interior portion 16 to lubricate and protect the bearing 14 during rotation of the shaft 18. In some embodiments, the bearing assembly 10 may remain in service and operate throughout the flushing process. For example, the shaft 18 may be operatively rotating throughout the flushing process, as generally indicated by arrow R. According to various embodiments, a method of flushing the bearing assembly 12 of the grease lubricant 30, such as when the grease lubricant has deteriorated or become contaminated through use, may include introducing a bearing flushing composition 32 comprising a grease component and a solvent component as described herein into the interior portion 16.

Figure 1B:
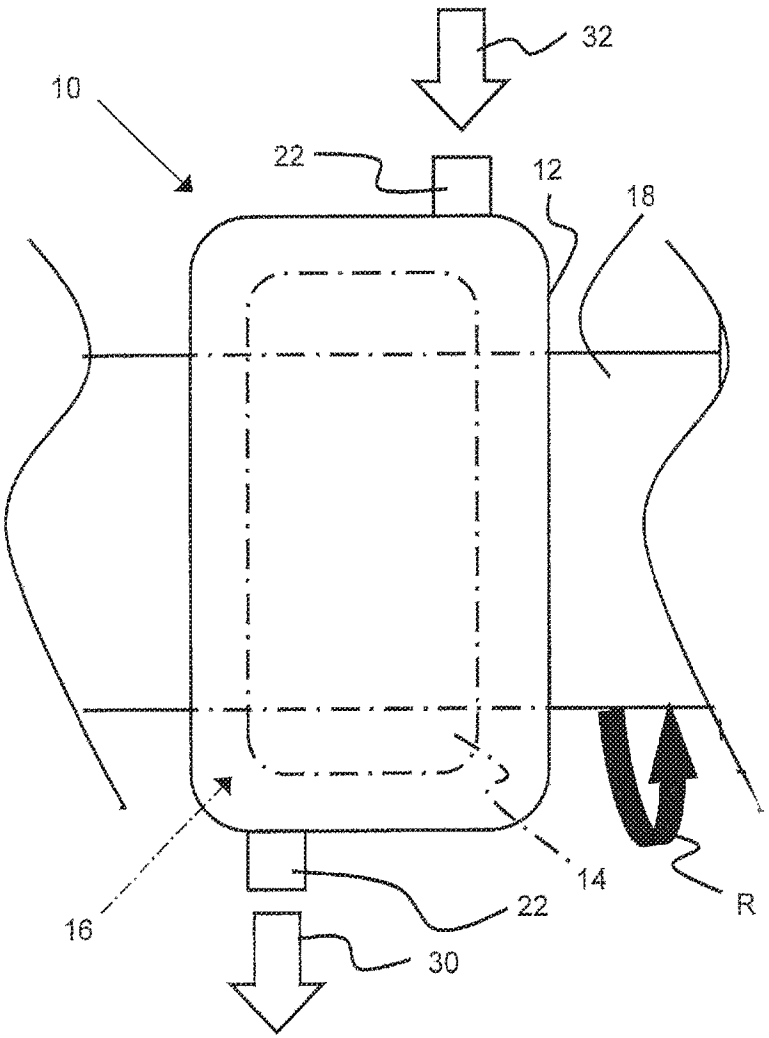

As depicted in FIG. 1B, the bearing lubricant composition 32 may be introduced into the interior portion 16 of the bearing assembly housing 12 through grease inlet 20. Introducing the bearing flushing composition may include injecting the bearing flushing composition into the interior portion 16, e.g., with a grease gun or pump. Introducing the bearing flushing composition 32 into the interior portion 16 of the bearing assembly housing 16 may result in displacement and flushing of all or a portion, such as a significant portion, of the old grease from the interior portion 16 through the grease outlet 22.

Figure 1C:
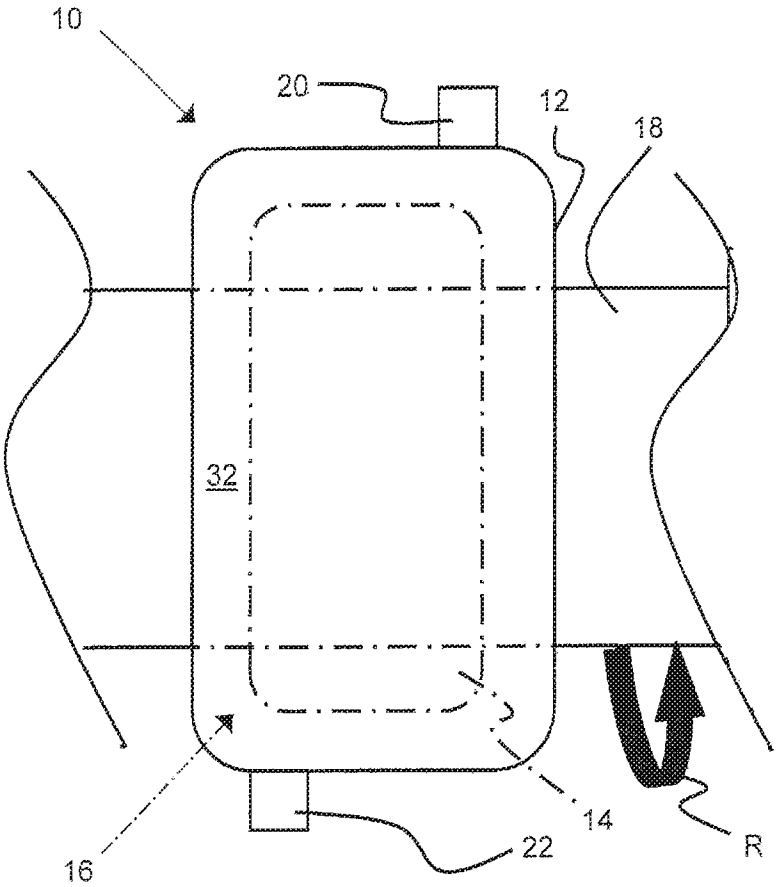

With specific reference to FIG. 1C, once the bearing flushing composition 32 has displaced and flushed all, a portion, such as a significant portion, of the old contaminated grease from the interior portion 16 of the bearing assembly housing 12 the bearing 14 may be run for a run period, e.g., the shaft 18 may remain in service. The run period is preferably at least approximately 4 hours, and preferably from approximately 4 to approximately 8 hours for main shaft bearings of wind turbines; however, longer or short run periods may be used, for example, based on the amount of cleaning desired. During the run period, the bearing flushing composition 32 breaks down buildup, contaminants, hardened grease deposits, a collects debris to clean the bearing 14 and bearing assembly housing 12. In some examples, performance additives, such as polishing agents, may interact with contaminants remaining within the interior portion 16 of the bearing assembly housing 12 thereby loosening or abrading the contaminants from metal surfaces inside the bearing assembly housing 12, which may then become suspended in the bearing flushing composition 32.

To maximize cleaning effectiveness, additional bearing flushing composition 32 (not shown) may optionally be introduced into the bearing assembly 10 system at one or more points during the run period. For example, additional bearing cleaning composition 32 may be injected approximately halfway through the run period to flush out deposits displaced up to that point in the cleaning cycle.

Figure 1D:
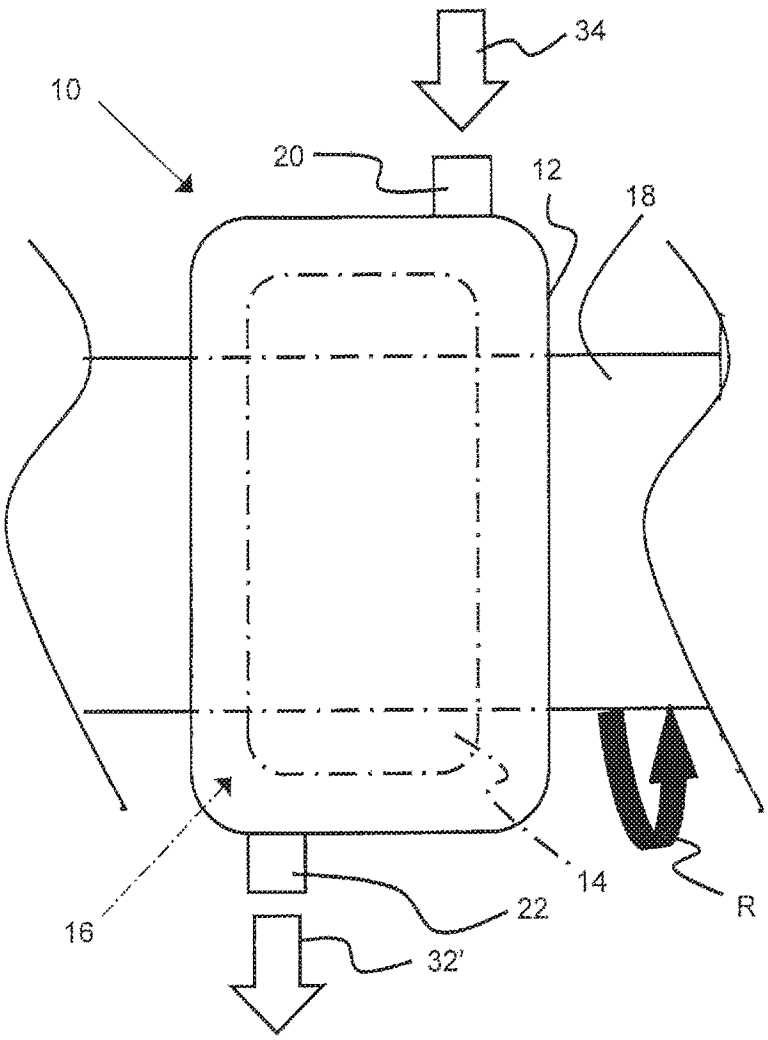

With specific reference to FIG. 1D, the method may also include flushing the bearing flushing composition 32. For example, at the end of the run period, the method may include flushing the used bearing flushing composition 32' from the bearing assembly 10. For example, re-lubricating grease 32 may be introduced via grease inlet 20 to displace the used bearing flushing composition 32' from grease outlet 22. In various embodiments, the re-lubricating grease 32 may be introduced with the bearing 14 still in operation to flush the bearing flushing composition 32' from the interior portion 16 of the bearing assembly housing 12. The re-lubricating grease 34 will typically be clean grease of the type normally used during regular service. Injection of the re-lubricating grease 34 may be continued until the used bearing flushing composition 32' is no longer being expelled from the bearing assembly 10, e.g., from grease outlet 22. As with all greases, care should be taken to avoid contamination of fresh supplies of the bearing cleaning composition when not in use. The amounts and percent compositions described herein with respect to the bearing flushing composition, components, and agents thereof are intended to be applicable to any combination of amounts or percent composition described herein with respect to the bearing flushing composition, components, or agents thereof consistent with this disclosure. Similarly, it will be appreciated that the bearing flushing composition may include any combination of the various components and agents identified herein consistent with this disclosure. Other alterations and modifications of the invention will likewise become apparent to those of ordinary skill in the art upon reading this specification, and it is intended that the scope of the invention disclosed herein be limited only by the broadest interpretation of the appended claims to which the inventors are legally entitled.

Various embodiments are described and illustrated in this specification to provide an overall understanding of the function, operation, and implementation of the disclosed compositions and methods. It is understood that the various embodiments described and illustrated in this specification are non-limiting and non-exhaustive. Thus, the invention is not necessarily limited by the description of the various non-limiting and non-exhaustive embodiments disclosed in this specification. The features and characteristics illustrated and/or described in connection with various embodiments may be combined with the features and characteristics of other embodiments. Such modifications and variations are intended to be included within the scope of this specification. As such, the claims may be amended to recite any features or characteristics expressly or inherently described in, or otherwise expressly or inherently supported by, this specification. Further, Applicant reserves the right to amend the claims to affirmatively disclaim features or characteristics that may be present in the prior art. The various embodiments disclosed and described in this specification can comprise, consist of, or consist essentially of the features and characteristics as variously described in this specification.

Also, any numerical range recited in this specification is intended to include all sub-ranges of the same numerical precision subsumed within the recited range. For example, a range of "1 to 10" is intended to include all sub-ranges between (and including) the recited minimum value of 1 and the recited maximum value of 10, that is, having a minimum value equal to or greater than 1 and a maximum value equal to or less than 10, such as, for example, 2.4 to 7.6. Any maximum numerical limitation recited in this specification is intended to include all lower numerical limitations subsumed therein and any minimum numerical limitation recited in this specification is intended to include all higher numerical limitations subsumed therein. Measurements preceded by the term approximately or similar are intended to include the measurement +/−5%. Accordingly, Applicant reserves the right to amend this specification, including the claims, to expressly recite any sub-range subsumed within the ranges expressly recited in this specification. All such ranges are intended to be inherently described in this specification such that amending to expressly recite any such sub-ranges would comply with the requirements of 35 U.S.C. §§ 112(a) and 132(a).

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

What is claimed is:

1. A method of flushing a bearing assembly, the method comprising:

introducing a bearing flushing composition into a bearing assembly housing comprising a bearing, the bearing flushing composition comprising a solvent component in an amount between 5% and approximately 20% by weight blended with a grease component, wherein introducing the bearing flushing composition into the bearing assembly housing displaces grease resident in the bearing assembly housing from the bearing assembly housing; and introducing a replacement grease into the bearing assembly housing, wherein introducing the replacement grease into the bearing assembly housing displaces the bearing flushing composition from the bearing assembly housing.

2. The method as in claim 1, further comprising operating the bearing for a run time after introducing the bearing flushing composition while the bearing flushing composition is resident in the bearing assembly housing.

3. The method as in claim 2, wherein the run time is at least 4 hours.

4. The method as in claim 1, wherein the bearing flushing composition and the replacement grease are introduced into the bearing assembly housing through a grease inlet.

5. The method as in claim 4, wherein the grease inlet comprises a Zerk type fitting.

6. The method as in claim 1, wherein displacement of the grease resident in the bearing assembly housing upon introducing the bearing flushing agent flushes the grease from the bearing assembly housing through a grease outlet.

7. The method as in claim 6, wherein the grease outlet comprises a Zerk type fitting.

8. The method as in claim 1, wherein the bearing flushing agent is introduced when the bearing is in service.

9. The method as in claim 1, wherein the replacement grease is introduced when the bearing is in service.

10. The method as in claim 1, wherein the grease component comprises (a) a grease thickener component, (b) base oil component, and, optionally, (c) a performance additive component.

11. The method as in claim 1, wherein the solvent component comprises one or more solvent agents blended with the grease component.

12. The method as in claim 1, wherein the bearing flushing composition comprises at least 10% by weight solvent component.

13. The method as in claim 1, wherein the bearing flushing composition comprises approximately 80% to approximately 95% grease component.

14. The method as in claim 1, wherein the grease component comprises approximately 1% to approximately 10% performance additive component.

15. The method as in claim 14, wherein the performance additive component comprises one or more performance additives selected from one or more antioxidant agents, one or more friction modifier agents, one or more anti-wear agents, one or more extreme pressure agents, one or more antirust agents, one or more polishing agents, and any combination thereof.

16. The method as in claim 1, wherein the solvent component comprises one or more oil soluble solvent agents solubilized into the grease thickener component.

17. The method as in claim 1, wherein the solvent component comprises one or more solvent agents solubilized in the grease component.

18. The method as in claim 1, wherein the solvent component is solubilized into the grease component.

* * * * *